United States Patent [19]

Elton

[11] Patent Number: 4,510,077

[45] Date of Patent: Apr. 9, 1985

[54] SEMICONDUCTIVE GLASS FIBERS AND METHOD

[75] Inventor: Richard K. Elton, Altamont, N.Y.

[73] Assignee: General Electric Company, Schenectady, N.Y.

[21] Appl. No.: 548,338

[22] Filed: Nov. 3, 1983

[51] Int. Cl.[3] ..... H01B 1/06; H01B 5/02

[52] U.S. Cl. ..... 252/502; 252/510; 252/511; 524/47; 524/62; 524/79; 524/494; 106/213; 427/82; 427/86; 427/87

[58] Field of Search ..... 252/502, 510, 511, 518; 524/27, 35, 47, 62, 79, 494; 106/162, 163 R, 171, 191, 199, 210, 213; 427/82, 86, 87

[56] References Cited

U.S. PATENT DOCUMENTS

| | | | |
|---|---|---|---|
| 2,409,893 | 10/1946 | Pendleton et al. | 252/510 |
| 3,664,855 | 5/1972 | Morrison et al. | 524/35 |
| 3,947,278 | 3/1976 | Youtsey | 524/79 |
| 3,975,201 | 8/1976 | Greenstein | 524/314 |
| 4,107,092 | 8/1978 | Carnahan et al. | 252/518 |
| 4,471,072 | 9/1984 | Leyerle et al. | 502/413 |

*Primary Examiner*—John Kight
*Assistant Examiner*—Nathan M. Nutter
*Attorney, Agent, or Firm*—John F. Ahern; Paul Checkovich

[57] ABSTRACT

A semiconductive material which is formed by impregnating glass fibers or glass fabric with an organic material which is pyrolyzed in the substantial absence of oxygen and at a temperature which is above the pyrolysis temperature of the organic material, but below the boiling point or sublimation temperature of the organic material. By such pyrolysis, the organic compound is converted to substantially pure carbon deposited on the glass fibers which impart to the glass fibers semiconductive characteristics.

27 Claims, No Drawings

SEMICONDUCTIVE GLASS FIBERS AND METHOD

BACKGROUND OF THE INVENTION

The present invention relates to semiconductive materials and, more particularly, the present invention relates to semiconductive glass fibers and fabrics.

Semiconducting materials are widely known at the present time. These materials have been developed and investigated for substantial periods of time for many applications. One of the applications for which such materials have been developed is a protective and insulating material which is able to dissipate static electricity. Semiconducting materials which will dissipate static electricity have been developed for many uses. The term "semi-conducting" herein refers to a material having a resistivity in the range of $10^{-1}$ ohms per square to $10^{12}$ ohms per square, which upper and lower resistivity values define insulators and conductors respectively. Some such materials generally comprise a fabric which is impregnated with a semiconducting material and thus becomes semiconductive. Another method of making such semiconductive materials is to utilize a carbon or other type of semiconducting paint and paint it onto a particular type of fabric whereupon the fabric becomes semiconductive. One of the difficulties with such materials has been that they are difficult to form into intricate and complex shapes. Further, for the most part, such prior art semiconductive materials have been susceptible to temperature changes and changes in ambient conditions. Furthermore, paints which contain conductive fillers are difficult to apply reproducibly, because the resulting resistivity of the cured coating is highly dependent on such variables as mixing time and solvent content. In addition, most such materials are quite expensive to produce and are difficult to justify for applications where large amounts of them have to be used.

For many applications, it is necessary that such semiconductive materials be tough and have a high degree of abrasion resistance. Further, it should be possible to control the resistivity of the semiconductive materials such that it can be produced to a certain resistivity for certain types of applications. Such semiconductive materials are particularly glass fabrics that are semiconductive and that have the above properties have been found suitable for many applications and are suitable for applications in the construction of numerous devices.

It is one object of the present invention to provide for an inexpensive and abrasion-resistant semiconductive material.

It is an additional object of the present invention to provide for semiconductive glass fibers and glass fabrics which are inexpensive to produce, abrasion-resistant and resistant to ambient conditions.

It is still an additional object of the present invention to provide for a semiconductive glass fabric whose resistivity can be varied easily and controllably for different applications of the material.

It is yet an additional object of the invention to provide for semiconductive glass fibers and glass fabric which can be molded or formed with facility to any shape that is desired.

It is yet still another object of the present invention to provide for a simple and cheap static electricity dissipating fabric.

It is yet a further object of the present invention to provide for a method for producing inexpensive semiconducting glass fibers.

It is yet a still further object of the present invention to provide for a method for producing an abrasion-resistant, static electricity dissipating glass fabric whose resistivity can be easily controlled and which can be easily formed to the desired shape.

These and other objects are accomplished by means of the invention described herein below.

SUMMARY OF THE INVENTION

In accordance with the above objects, there is provided by the present invention, a semiconducting material comprising glass fibers which are heat-treated in the substantial absence of oxygen in the presence of an effective amount of organic compound to secure the desired semiconducting characteristics.

The glass fibers may be utilized as chopped strands, filament roving, or woven into glass cloth. The glass is desirably selected from glass formed from silicate glass fibers or may be selected from glass which is formed from magnesium aluminosilicate glass fibers. The silicate glass fibers are normally E-Glass which has a lower melting temperature than is the case with the other glass fibers formed from S-Glass.

Generally, the glass fibers or glass fabrics are made semiconducting in accordance with the present invention by depositing an organic compound on the glass fibers by any method, preferably by either immersing or dipping, spraying or brushing the organic compound on the glass cloth or fibers and pyrolyzing the organic compound to produce a pyrolysate containing largely carbon in the absence of oxygen. In this manner, the glass fiber or glass cloth can be made semiconducting such that it has a resistivity in the range of 200 to 10,000,000 ohms per square. The semiconductivity or resistivity of glass fibers can be varied as desired by the amount and species of organic material that is added to the glass cloth or glass fibers, the pyrolysis temperature, time cycle, and the pyrolysis atmosphere. Further, the resistivity of the glass fibers may also be varied by immersing the pyrolyzed glass cloth or impregnating the glass cloth with various types of resins such as thermosetting polyester or epoxy resins.

DESCRIPTION OF THE PREFERRED EMBODIMENT

As mentioned previously, generally although the semiconducting material of the present invention can be formed from various glass fibers, it is preferably formed from E-Glass and S-Glass fibers. These are two common glass fibers that are employed filaments or woven into glass cloth for industrial applications. One basic difference between the S-Glass from E-Glass is that it can tolerate higher temperatures; that is, its melting point is higher than that of E-Glass. Any type of glass fibers can be utilized in the instant case and particularly any type of glass fibers that can be woven into glass cloth.

The organic compound which is deposited thereon is an organic compound selected from organic compounds in which a majority of the atoms in the compound are hydrogen, carbon and oxygen atoms, or organic compounds in which a majority of the atoms are carbon and hydrogen atoms.

The organic compound may be any organic compound composed of such atoms in which the volatility of the compound is low at the temperatures at which pyrolytic degradation begins to occur. This is necessary to ensure that a significant amount of the said organic material does not volatilize and leave the glass substrate, but rather remains on the glass as a residue, and ultimately is transformed into a conductive substance composed primarily of carbon.

In order to obtain effective pyrolysis of the organic compound it is necessary to heat the glass fibers and the compound to temperatures of 600° C. and above. However, it is necessary that enough of the compound or degradation products of the compound remain on the glass, so as to leave behind an acceptable mass of conductive char. If, for example, a material has a boiling point or sublimation point below 600° C., most or all of it will leave the glass before pyrolysis can occur. Similarly, a material which decomposes below 600° C. must not decompose entirely into volatile or gaseous products for the same reason. Accordingly, it is necessary that the organic compound not have a boiling point or sublimation point below 600° C., and that it degrade to produce a nonvolatile char or residue that ultimately results in a semiconducting substance composed largely of carbon. Further, even if the compound in its original state does not meet these conditions, if it polymerizes upon elevating the temperature to a compound that meets these criteria, then it is suitable in the present application.

It is felt that any organic compound, even one that has minor amounts of atoms of other elements such as nitrogen and sulfur will work in the instant case so long as the majority of atoms in the organic compound are composed of either carbon, hydrogen and oxygen or carbon and hydrogen. One very suitable organic compound that has been found in the present case to fit the above definitions is starch, particularly amylose starch. Starch is frequently used as a sizing the manufacture of glass fabrics because when coated on the glass fibers, it imparts enough strength to allow the glass threads to endure the rigors of the weaving process. The amylose starch is preferred, because of its solubility and dispersibility.

A starch which is composed of both the soluble and insoluble component can be also utilized in the instant case. Such starch generally has the formula:

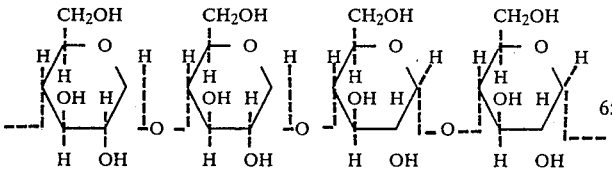

see, e.g., Fieser and Fieser, *Textbook of Organic Chemistry*, D. C. Heath and Company (1950). Again, the starch of the above formula is composed of a soluble component which is known as amylose and an insoluble residue which is known as amylopectin. Either type can be utilized in the instant application, although the soluble component is preferred.

In the combination with the starch, there may be utilized as another organic compound, a lubricant which may be a distillate or vegetable oil, or one of the compounds indicated below. This substance is used to impart lubrication to and between the individual glass fibers, and as such permits the threads and cloths manufactured from these fibers to be subjected to mechanical stresses as incurred by bending, folding and twisting without breakage of the fibers. It may also function to disperse the starch on the fibers and allow it to adhere thereto.

Distillate oils are obtained from petroleum. The basic constituents of petroleum are olefinic and aliphatic hydrocarbons. Petroleum contains some light hydrocarbons of 5 or less carbon atoms. Fractions from natural gasoline or from petroleum containing hydrocarbons with 6 or more carbon atoms are complex mixtures not resolvable on a practicable scale into homogeneous chemical entities. Extensive research has resulted in isolation and identification of 28 paraffin hydrocarbons from the gasoline fraction. These include all the straight-chain hydrocarbons to n-decane and 18 branched chain alkanes, ranging from isobutane to methylnonanes.

Preferably there are utilized vegetable oils and marine oils with or without a dispersant as the organic compound in the instant invention.

Vegetable oils used alone or in conjunction with starch provide not only the desired lubricity, but other advantages over distillate oils in that they can be made to polymerize readily. The vegetable oil is preferably chosen from a group of unsaturated triglyceride oils. Such oils are composed of long chain unsaturated fatty acids which have reacted with glycerol. A typical unsaturated triglyceride oil is depicted below:

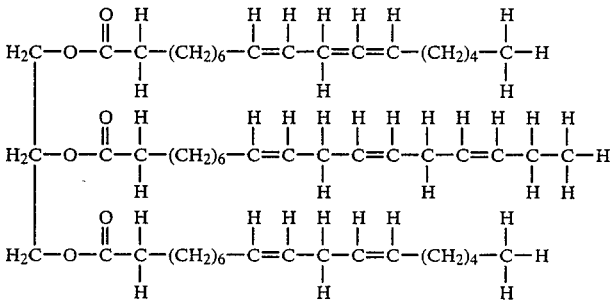

Such oils polymerize in the presence of oxygen to form a tough organic film. The polymerization process involves free radical addition polymerization, and cross-linking by oxygen atoms. Vegetable oils do not consist of a single chemical formula, but are mixtures of the reaction products of different fatty acids with glycerol. The following Table I lists the approximate fatty acid content in some of the most common vegetable oils:

TABLE I

VEGETABLE OILS

| FATTY ACIDS | | Unsaturation | Castor | Coconut | Corn | Cottonseed | Linseed | Oiticica |
|---|---|---|---|---|---|---|---|---|
| CAPRYLIC (Octanoic) | $C_8H_{16}O_2$ | | | 6 | | | | |
| CAPRIC (Decanoic) | $C_{10}H_{20}O_2$ | | | 6 | | x | | |
| LAURIC (Dodecanoic) | $CH_{12}H_{24}O_2$ | | | 44 | | x | | |
| MYRISTIC (Tetradecanoic) | $C_{14}H_{28}O_2$ | | | 18 | | 1 | | |
| PALMITIC (Hexadecanoic) | $C_{16}H_{32}O_2$ | | 2 | 11 | 13 | 29 | 6 | 7 |
| Palmitoleic (cis-9-Hexadecanoic) | $C_{16}H_{30}O_2$ | (−2H) | | | | 2 | x | |
| STEARIC (Octadecanoic) | $C_{18}H_{36}O_2$ | | 1 | 6 | 4 | 4 | 4 | 5 |
| Oleic (cis-9-Octadecenoic) | $C_{18}H_{34}O_2$ | (−2H) | 7 | 7 | 29 | 24 | 22 | 6 |
| Ricinoleic (12-Hydroxy-cis-9-Octadecenoic) | $C_{18}H_{34}O_3$ | (−2H) | 87 | | | | | |
| Linoleic (cis-9,cis-12-Octadecadienoic) | $C_{18}H_{32}O_2$ | (−4H) | 3 | 2 | 54 | 40 | 16 | |
| Linolenic (cis-9, cis-12, cis-15-Octadecatrienoic) | $C_{18}H_{30}O_2$ | (−6H) | | x | | | 52 | |
| Eleostearic (cis-9, trans-11, trans-13-Octadecatrienoic(?) | $C_{18}H_{30}O_2$ | (−6H) | | | | | | |
| Licanic (4-Keto-9, 11, 13-Octadecatrienoic) | $C_{18}H_{28}O_3$ | (−6H) | | | | | | 78 |
| ARACHIDIC (Eicosanoic) | $C_{20}H_{40}O_2$ | | | | x | x | x | |
| Arachidonic (5, 8, 11, 14-Eicosatetraenoic) | $C_{20}H_{32}O_2$ | (−6H)-(−10H) | | | | | | |
| BEHENIC (Docosanoic) | $C_{22}H_{44}O_2$ | | | | | | | |
| Clupanodonic (4 (?), 8, 12, 15, 19-Docosapentaenoic) | $C_{22}H_{36}O_2$ | (−6H)-(−10H) | | | | | | |
| LIGNOCERIC (Tetracosanoic) | $C_{24}H_{48}O_2$ | | | | | | | |
| Nisinic (4 (?), 8, 12, 15, 18, 21-Tetracosahexaenoic) | $C_{24}H_{38}O_2$ | (−10H) | | | | | | |

| FATTY ACIDS | | Unsaturation | Olive | Peanut | Safflower | Soy bean | Tung | Black Walnut | Sun-flower |
|---|---|---|---|---|---|---|---|---|---|
| CAPRYLIC (Octanoic) | $C_8H_{16}O_2$ | | | | | | | | |
| CAPRIC (Decanoic) | $C_{10}H_{20}O_2$ | | | | | | | | |
| LAURIC (Dodecanoic) | $CH_{12}H_{24}O_2$ | | | | | | | | |
| MYRISTIC (Tetradecanoic) | $C_{14}H_{28}O_2$ | | x | x | x | x | | | |
| PALMITIC (Hexadecanoic) | $C_{16}H_{32}O_2$ | | 14 | 6 | 8 | 11 | 4 | 11 | 11 |
| Palmitoleic (cis-9-Hexadecenoic) | $C_{16}H_{30}O_2$ | (−2H) | 2 | x | x | | | | |
| STEARIC (Octadecanoic) | $C_{18}H_{36}O_2$ | | 2 | 5 | 3 | 4 | 1 | 5 | 6 |
| Oleic (cis-9-Octadecenoic) | $C_{18}H_{34}O_2$ | (−2H) | 64 | 61 | 13 | 25 | 8 | 28 | 29 |
| Ricinoleic (12-Hydroxy-cis-9-Octadecenoic) | $C_{18}H_{34}O_3$ | (−2H) | | | | | | | |
| Linoleic (cis-9,cis-12-Octadecadienoic) | $C_{18}H_{32}O_2$ | (−4H) | 16 | 22 | 75 | 51 | 4 | 51 | 52 |
| Linolenic (cis-9, cis-12, cos-15-Octadecatrienoic) | $C_{18}H_{30}O_2$ | (−6H) | 2 | x | 1 | 9 | 3 | 5 | 2 |
| Eleostearic (cis-9, trans-11, trans-13-Octadecotrienoic(?) | $C_{18}H_{30}O_2$ | (−6H) | | | | | 80 | | |
| Licanic (4-Keto-9, 11, 13-Octadecatrienoic) | $C_{18}H_{28}O_3$ | (−6H) | | | | | | | |
| ARACHIDIC (Eicosanoic) | $C_{20}H_{40}O_2$ | | x | 2 | x | x | | | |
| Arachidonic (5, 8, 11, 14-Eicosatetraenoic) | $C_{20}H_{32}O_2$ | (−6H)-(−10H) | | | | | | | |
| BEHENIC (Docosanoic) | $C_{22}H_{44}O_2$ | | | 3 | | | | | |
| Clupanodonic (4 (?), 8, 12, 15, 19-Docosapentaenoic) | $C_{22}H_{36}O_2$ | (−6H)-(−10H) | | | | | | | |
| LIGNOCERIC (Tetracosanoic) | $C_{24}H_{48}O_2$ | | | 1 | | | | | |
| Nisinic (4 (?), 8, 12, 15, 18, 21-Tetracosahexaenoic) | $C_{24}H_{38}O_2$ | (−10H) | | | | | | | |

Similarly, oils derived from animal by-products, known as marine oils, also contain a degree of unsaturation, and will polymerize in the presence of oxygen. Table II shows the composition of some of these oils:

TABLE II

MARINE OILS AND FATS

| FATTY ACIDS | | Unsaturation | Herring | Manhaden | Pilchard | Sardine |
|---|---|---|---|---|---|---|
| CAPRYLIC (Octanoic) | $C_8H_{16}O_2$ | | | | | |
| CAPRIC (Decanoic) | $C_{10}H_{20}O_2$ | | | | | |
| LAURIC (Dodecanoic) | $CH_{12}H_{24}O_2$ | | | x | | |
| MYRISTIC (Tetradecanoic) | $C_{14}H_{28}O_2$ | | 7 | 7 | 5 | 6 |
| PALMITIC (Hexadecanoic) | $C_{16}H_{32}O_2$ | | 14 | 16 | 15 | 10 |
| Palmitoleic (cis-9-Hexadecenoic) | $C_{16}H_{30}O_2$ | (−2H) | 6(−3H) | 16 | 12 | 13 |
| STEARIC (Octadecanoic) | $C_{18}H_{36}O_2$ | | 1 | 2 | 3 | 2 |
| Oleic (cis-9-Octadecenoic) | $C_{18}H_{34}O_2$ | (−2H) | 21(−3.5H.) | 15 | 6 | 24 |
| Ricinoleic (12-Hydroxy-cis-9-Octadecenoic) | $C_{18}H_{34}O_3$ | (−2H) | | | | |
| Linoleic (cis-9, cis-12-Octadecadienoic) | $C_{18}H_{32}O_2$ | (−4H) | | 7 | 12 | |
| Linolenic (cis-9, cis-12, cis-15-Octadecatrienoic) | $C_{18}H_{30}O_2$ | (−6H) | | 2 | | |
| Eleostearic (cis-9, trans-11, trans-13-Octadecatrienoic(?) | $C_{18}H_{30}O_2$ | (−6H) | | | | |
| Licanic (4-Keto-9, 11, 13-Octadecatrienoic) | $C_{18}H_{28}O_3$ | (−6H) | | | | |
| ARACHIDIC (Eicosanoic) | $C_{20}H_{40}O_2$ | | x | | | |
| Arachidonic (5, 8, 11, 14-Eicosatetraenoic) | $C_{20}H_{32}O_2$ | (−6H)-(−10H) | 28(−4.8H) | 17(−10H) | 18 | 26 |
| BEHENIC (Docosanoic) | $C_{22}H_{44}O_2$ | | | | | |
| Clupanodonic | $C_{22}H_{36}O_2$ | (−6H)-(−10H) | 23(−4.8H) | 11(−10H) | 14 | 19 |

TABLE II-continued

| FATTY ACIDS | | Unsaturation | Herring | Manhaden | Pilchard | Sardine |
|---|---|---|---|---|---|---|
| | | MARINE OILS AND FATS | | | | |
| (4 (?), 8, 12, 15, 19-Docosapentaenoic) | | | | | | |
| LIGNOCERIC (Tetracosanoic) | $C_{24}H_{48}O_2$ | | | | | |
| Nisinic | $C_{24}H_{38}O_2$ | (−10H) | x(−4H) | 4(−10H) | 15 | |
| (4 (?), 8, 12, 15, 18, 21-Tetracosahexaenoic) | | | | | | |
| Shibic (Hexacosapentaenoic) | $C_{26}H_{42}O_2$ | (−10H) | | 1(−10H) | | |
| Unnamed (Octacosapentaenoic) | $C_8H_{2n-10}O_2$ | (−10H) | | 2(−10H) | | |

The above oils, once polymerized, will pyrolyze readily at temperatures above 600° C. to yield the desired carbon product on the glass fibers. Some of these oils are triglycerides produced by the reaction of glycerol with conjugated fatty acids. Such oils will polymerize more readily at elevated temperatures to yield products which have the desired pyrolyzation properties. The other oils which are formed from non-conjugated fatty acids polymerize less readily; but at temperatures of 600° C. or above will react to yield products with the desired pyrolyzation properties (see "Federation Series on Coating Technology; Unit 3; Oils For Organic Coating"; published by Federation of Societies for Paint Technology, pages 1–47, (1974)).

The most preferred organic compound in the instant case is a mixture of 30–70% by weight starch with 30–70% by weight of one of the above oils. The organic compound can also be totally selected from one of the above preferred triglyceride vegetable oils and from one of the marine oils of Table II. Other organic compounds or mixtures thereof may be utilized as organic compounds in the instant case, provided they have relatively low vapor pressures at the pyrolysis temperatures. For this reason, many of the most suitable compounds are polymeric materials, resinous materials which polymerize upon heating, or materials which can be made to polymerize by reaction with another reagent such as oxygen or water. Although a wide variety of polymeric materials exist which can be utilized in the instant case, a few that have been picked as representative are:

cellulose
starch
polystyrene
acrylic latex
epoxy dispersions
acrylic dispersions
polyester dispersions
polyethylene
polypropylene Similarly, a wide variety of reactive resins can be utilized, of which the following are representative:

epoxy resins
polyester resins
oil-modified polyester resins
polyurethane resins
phenolic resins Similarly, many polymerizing substances which require an external reactant, such as oxygen or water, may be utilized as the organic compound or with one of the compounds from the above lists. The following list of compounds is representative:

linseed oil
tung oil
castor oil
blown linseed oil
blown walnut oil
safflower oil
cottonseed oil
fish oil
oiticica oil Any of the above compounds can be used in any proportions in the instant case. The preferable combination is one in which the solid compounds at a concentration of 30–70% by weight are mixed with one of the oils at a concentration of 30–70% by weight.

There may be utilized or may be deposited on the glass fibers at least an effective amount of such organic compound which is capable of rendering the glass fibers semiconductive. An effective amount is defined as that minimum amount of organic compound which when pyrolyzed on the glass fibers will impart to the glass fibers some conductivity. More preferably, there is utilized 0.5–30% by weight of the organic compound based on the weight of the glass fibers. If more than 30% is utilized, then the glass fibers may accumulate such a large quantity of char that the char does not adhere readily to the fibers. Such a condition results in major increases in resistivity as the glass fibers are flexed, due to removal of carbonaceous material from the fibers. More preferably there is utilized from 2–4% by weight of the organic compound mixture based on the weight of the glass fibers. This organic compound is added to the glass fibers preferably as they are formed or subsequently after they have been woven into glass cloth. The organic compound may be added to the glass fibers as they are formed as a lubricant and sizing agent.

To the organic compound there is preferably added a dispersant. Examples of suitable dispersants are water, hydrocarbon solvents, aromatic solvents, ketone solvents and alcohol solvents. Examples of dispersants are acetone, methyl ethyl ketone, xylene, toluene, cyclohexane, cycloheptane, methanol, ethanol, etc.

The organic compound is applied to the glass fiber as stated previously, either by immersion such as dipping, spraying, brushing, etc. The organic compound may be applied after the glass fibers are formed into fabric. Preferably, however, it is applied before the fibers are formed into a glass fabric.

In the case of a glass fabric, after it is formed, it may be placed in an oven to cure any reactive resins on the fabric if necessary. It is then placed in a furnace where oxygen has been largely or entirely excluded, either by pulling a vacuum, or by introduction of another gas such as argon or nitrogen. The glass is then heated in the furnace to temperatures of at least 600° C. and up to 850° C. and more preferably from 650° C. to 750° C. The temperature to which the glass fabric can be heated to pyrolyze the organic compound will vary depending on the type of glass fibers. Thus, if S-Glass is utilized, then the temperature should not exceed 850° C. If E-Glass is utilized, then the temperature should not exceed 720° C. If the temperature is exceeded, then the glass fibers will begin to melt, weakening the tensile strength of the glass fabric. Accordingly, most preferably, the pyrolysis temperature is in the range of 650° C. to 750° C., for most glass fabrics.

The pyrolysis is preferably carried out at atmospheric pressure, although pressures above or below atmospheric may be utilized. The heating is carried on for a period of time of anywhere from a few minutes to 48 hours, and more preferably from 1 hour to 20 hours. There is a certain amount of time necessary to heat the fibers up to pyrolysis temperature so as to not weaken them by overheating and there is a certain amount of time necessary to cool the fibers, since it is not desirable to cool them too quickly. This period of time is normally in the range of two hours, depending on the volume of material, and its form, i.e., fibers, fabric or yarn. Besides the temperature at which the organic compound is heated, the other important condition necessary in the process of forming the carbon deposited glass fiber is the atmosphere in which it is heated.

As stated previously, if one of the compounds in the mixture is an oxygen-containing compound, then the atmosphere in which the pyrolysis is carried out should be an atmosphere which contains no oxygen such as an inert gas atmosphere. Examples of inert gases that can be utilized are, for instance, nitrogen, helium, argon, neon, xenon, etc. Argon or nitrogen are the preferred inert gas atmosphere since they are most readily available.

In the claims and in the specification by the term that the compound is pyrolyzed "in the substantial absence of oxygen" it is meant that there can be up to 2% of oxygen in the atmosphere that is used to pyrolyze the organic compound.

After the glass fibers have been pyrolyzed, they are cooled to room temperature to form semiconductive glass fibers.

This type of glass fabric may be used for many applications in which an inexpensive but semiconducting insulative tape of superior strength and abrasion resistance is desired.

Utilizing the above methods and techniques, there is desirably obtained a glass fabric formed from glass fibers having a resistivity preferably in the range of 200 to 10,000,000 ohms per square which can be further increased by the immersion or the impregnation of the glass tape with other plastics, such as epoxies and thermosetting resins. Thus, for example, by the impregnation of such a glass fabric with the epoxy resin disclosed in Torossian, U.S. Pat. No. 4,103,195, it is possible to increase the resistivity from 8,000 ohms per square up to 40,000 ohms per square. Further, the resistivity may be varied to a lower or higher value as described by impregnation with other resins or by varying the pyrolysis time-temperature cycle.

The examples below are given for the purpose of illustrating methods of producing the semiconducting glasses of the present invention. They are not given for any purpose of setting limits and boundaries to the instant invention.

The following test was used to measure the resistivity of all the samples tested in the examples below. The test apparatus consisted of a ohmmeter connected to a probe. The probe comprised two parallel pieces of brass plates. Each plate was 1" wide by 1/16" in thickness and was spaced 1" apart. These brass plates were attached 1" apart on either side of a 1"×1"×5" long, nonconductive plastic bar. The 1" wide by 1/16" thickness of the two plates was applied over the fabric to be tested with a pressure of about 15 lbs. or slightly over. The current that was then passed from one brass plate to the other was created by a 9-volt battery. The resistivity or conductance of the fabric was then measured on the ohmmeter. Typically, five readings were taken on the ohmmeter and the average of these readings was utilized as the resistivity.

Further, all glass fabrics that were used in the examples below had the starch and oil sizing that was applied to them by the manufacturer.

EXAMPLE 1

A 72-yard roll of ¾" wide and 0.004" thick woven fiberglass tape made from E-Glass was obtained from Carolina Narrow Fabrics Company, Winston-Salem, N.C., and had about 1% by weight of oil and starch sizing that was applied by the manufacturer. This fabric was treated by immersion in a bath containing 50% of a low viscosity alkyd resin (sold under the trade name, Product No. 9522, by the General Electric Company, Schenectady, N.Y.) in xylene for 8 hours. The roll was then allowed to dry at 25° C. for several days. Following this, it was loosely wrapped in a copper foil packet, and placed in a vacuum furnace. The furnace was evacuated to a pressure of less than 1 mm Hg for several hours, and then backfilled with argon to about 600 mm Hg pressure. Following this, the temperature was raised from 25° C. to 700° C. over a 2-hour period, held at 700° C. for 1 hour and then returned to 25° C. over about 15 hours. The furnace was then opened, and the sample removed. The glass fabric appeared shiny black and slippery to the touch. Samples of fabric from the exterior of the roll exhibited resistivities in the range of 400 to 1,300 ohms/square. Samples from the center of the roll exhibited resistivities in the range of 2,500–2,800 ohms/square.

EXAMPLE 2

A roll of E-Glass fabric similar to that described in Example 1 was obtained from Carolina Narrow Fabrics Co., North Carolina, which contained approximately 1% by weight of a starch and oil sizing on the fibers that had been applied during manufacture. This roll was wrapped in copper foil and placed in a vacuum furnace. The furnace was evacuated to a pressure of less than 1 mm Hg for 24 hours. Following this, argon was introduced until a pressure of about 600 mm Hg was reached. The temperature of the furnace was then increased from 25° C. to 720° C. over a 2-hour period and held at 720° C. for about 24 hours. The temperature of the oven was returned to 25° C. over about 15 hours. The fabric was removed and examined. Samples of fabric from the exterior of the roll exhibited resistivities around 8,000 ohms/square, and samples from the center of the roll measured about 10,500 ohms/square.

EXAMPLE 3

A sample of 0.007" thick woven S-Glass fabric sheet containing about 1% by weight of a starch and oil sizing was obtained from Burlington Glass Fabrics, Altavista, Va. It was placed in a loosely fitting steel canister which contained a pipe connected to a cylinder or argon. Argon was flushed through the canister for a period of several hours. With a continual flow of argon, the canister was placed in a cold furnace, and the temperature increased from 25° C. to 700° C. over a 2-hour period. The temperature was held at 700° C. for 24 hours and then returned to 25° C. over a 2-hour duration. The argon flow was then terminated and the sample was removed for examination. The glass fabric was examined and found to exhibit resistivities around 10,000 ohms/square.

For comparison, another sample of the same S-Glass fabric was prepared in an identical manner, except that it was heated to 600° C. for 24 hours instead of 700° C. The fabric produced in this manner had resistivities of 1,500,000 ohms/square when tested.

EXAMPLE 4

A sample consisting of ¼" chopped E-Glass fiber strands containing about 2.1% by weight starch and oil sizing on the fibers was obtained from The Owens Corning Company, Toledo, Ohio. These fibers were loaded into an iron pan and placed in a vacuum furnace. The furnace was evacuated to a pressure of less than 1 mm Hg for 24 hours, and then backfilled with argon to about 600 mm Hg pressure. The temperature of the furnace was then increased from 25° C. to 700° C. over a 2-hour period, held at 700° C. for 2 hours and returned to 25° C. over about 15 hours. The fibers were then removed and examined. To measure the resistivity, a loose mat of a sample of these fibers, measuring about 1/16" thick was formed on a Mylar polyester sheet (Mylar is the trade name of E. I. DuPont and Company). This mat, when tested, exhibited a resistivity of about 70,000 ohms/square.

A sample of these fibers were then hand mixed into a low-viscosity epoxy resin as defined in Markovitz, U.S. Pat. No. 3,812,214. The mat had a loading of 30 weight percent glass fibers. The mixture was placed between 2 sheets of polyfluorocarbon film and pressed between 160° C. platens in a bench-top press at a pressure of about 10 psi for 5 hours. The press platens were then cooled and the cured glass fiber-epoxy sheet removed. It measured about 0.020" thick and exhibited a resistivity in the range of 200,000 to 800,000 ohms/square.

EXAMPLE 5

An 8-foot length of E-Glass fabric 1" wide and 0.004" thick, similar to that cited in Example 1, which was obtained from Carolina Narrow Fabrics Co. and contained approximately 1% by weight of starch and oil sizing was wound into the shape of a roll. The starch and oil sizing was placed on the fibers by the manufacturer. It was immersed in a 10% aqueous solution of sucrose ($C_{12}H_{22}O_{11}$) for about 60 seconds, removed, and placed in a 130° C. oven for 4 hours to dry. The dried fabric was found to contain approximately 2.4% by weight sucrose. This roll was then wrapped in copper foil and placed in a loosely fitting metal canister. The canister was flushed with argon for 4 hours, and then placed in a cold furnace. The temperature was raised in the furnace from 25° C. to 700° C. over a 2-hour period, with a continual flow of argon. The temperature was held at 700° C. for 4 hours, and then returned to 25° C. over 2 hours. The fabric was removed and the resistivity was found to be in the range of 1,000 to 5,000 ohms/square.

EXAMPLE 6

An 8-foot length of E-Glass fabric, 1" side and 0.004" thick, similar to that cited in Example 1 which was obtained from Carolina Narrow Fabrics Co. and contained about the same sizing, was wound into the shape of a roll. It was immersed in a 50% solution of tung oil (an unsaturated triglyceride oil) in xylene for several minutes. (See "Federation Series on Coating Technology; Unit 3; Oils for Organic Coating"; published by Federation of Societies for Paint Technology, pages 1–47 (1974)). Then it was placed in a 130° C. oven to dry, during which time some polymerization of the tung oil occurred. The dried fabric consisted of approximately 26% by weight tung oil solids. This roll was wrapped in copper foil and placed in a loosely fitting metal canister. The canister was flushed with argon for 4 hours and placed in a cold furnace. The furnace temperature was increased from 25° C. to 700° C. over a 2-hour period, held at 700° C. for 4 hours, and then cooled to 25° C. over 2 hours with argon purging. The fabric was removed and found to exhibit resistivities in the range of 200 to 300 ohms/square.

The advantage of using a polymerizing vegetable oil over a non-polymerizing mineral oil can be shown by comparing a similar piece of E-Glass fabric obtained from Carolina Narrow Fabrics Co., which was soaked in a 50% solution of mineral oil in xylene, and dried 4 hours at 130° C. It contained approximately 23% by weight mineral oil. When pyrolyzed in a fashion identical to that given above, the resulting fabric exhibited resistivities in the range of 5,000 to 15,000 ohms/square.

What is claimed is:

1. A semiconductive material comprising glass fibers which are pyrolyzed in the substantial absence of oxygen in the presence of an effective amount of an organic compound to render said glass fibers semiconducting by forming carbon deposited glass fibers.

2. The semiconductive material of claim 1 wherein the glass fibers are silicate glass fibers which are woven into glass cloth.

3. The semiconductive material of claim 1 wherein the glass fibers are magnesium aluminosilicate glass fibers which are woven into glass cloth.

4. The semiconductive material of claim 2 wherein there is present from 0.5 to 30% by weight of the organic compound based on the weight of the glass cloth.

5. The semiconductive material of claim 4 wherein there is present from 2–4% by weight of the organic compound based on the weight of the glass cloth.

6. The semiconductive material of claim 4 wherein the organic compound is a compound selected from the class consisting of compounds in which a majority of the atoms are hydrogen, carbon and oxygen atoms; compounds in which a majority of the atoms are carbon and hydrogen atoms; and mixtures of said compounds.

7. The semiconductive material of claim 6 wherein the organic compound is a mixture of starch and an oil.

8. The semiconductive material of claim 6 wherein the organic compound is selected from compounds which pyrolyze at a temperature of 600° C. or above but which do not have a boiling or sublimition temperature that is below their pyrolyzation temperature, or which do not degrade to produce significant amounts of volatile decomposition products.

9. The semiconductive material of claim 8 wherein the organic compound is selected from the class consisting of starch, vegetable oils, marine oils and mixtures thereof.

10. The semiconductive material of claim 9 wherein there is further present a dispersant which is selected from the class consisting of water, hydrocarbon solvents, aromatic solvents, ketone solvents and alcohol solvents.

11. The semiconductive material of claim 10 which has a surface resistivity in the range of 200 to 10,000,000 ohms per square.

12. A process for producing a semiconductive material, comprising:

(a) depositing an effective amount of an organic compound on glass fibers;

(b) pyrolyzing the glass fibers and organic compound deposited thereon at a temperature of at least 600° C. in the substantial absence of oxygen to form carbon deposited glass fibers.

13. The process of claim 12 wherein the glass fibers and organic compound are pyrolyzed at a temperature in the range of 650°–850° C.

14. The process of claim 13 wherein the organic compound is pyrolyzed for a period of time in the range of 1 minute to 4 hours.

15. The process of claim 14 wherein the organic compound is deposited on said glass fibers by spraying.

16. The process of claim 15 wherein the organic compound is pyrolyzed in an atmosphere of an inert gas.

17. The process of claim 16 wherein the organic compound is pyrolyzed under atmospheric pressure.

18. The process of claim 12 wherein the glass fibers are silicate glass fibers which are woven into glass cloth.

19. The process of claim 12 wherein the glass fibers are magnesium aluminosilicate glass which are woven into glass cloth.

20. The process of claim 18 wherein there is present from 0.5 to 30% by weight of the organic compound based on the weight of the glass cloth.

21. The process of claim 20 wherein there is present from 2–4% by weight of the organic compound based on the weight of the glass cloth.

22. The process of claim 21 wherein the organic compound is a compound selected from the class consisting of compounds in which a majority of the atoms are carbon, hydrogen and oxygen atoms, compounds in which a majority of the atoms are carbon and hydrogen atoms; and mixtures of such compounds.

23. The process of claim 22 wherein the organic compound is selected from compounds which pyrolyze at a temperature of 600° C. or above but which do not have a boiling or sublimation temperature that is below their pyrolyzation temperature, or which do not degrade to produce significant amounts of volatile decomposition products.

24. The process of claim 12 wherein the organic compound is selected from the class consisting of starch, vegetable oils, mineral oils, and mixtures thereof.

25. The process of claim 24 wherein the organic compound is a mixture of the foregoing organic compound and a dispersant.

26. The process of claim 25 wherein the dispersant is selected from the class consisting of water, hydrocarbon solvents, aromatic solvents, ketone solvents and alcohol solvents.

27. The process of claim 26 wherein the semiconductive material has a resistivity in the range of 200 to 10,000,000 ohms per square.

* * * * *